US010682776B1

(12) United States Patent
Schmerler

(10) Patent No.: US 10,682,776 B1
(45) Date of Patent: Jun. 16, 2020

(54) METHOD OF CUSTOMIZATION AND ASSEMBLY OF THE PREFITTED KNIFE

(71) Applicant: 9226-1114 Quebec Inc., Montreal (CA)

(72) Inventor: Gabriel Schmerler, Montreal (CA)

(73) Assignee: 9226-1114 QUEBEC INC., Montreal, Quebec (CA)

( * ) Notice: Subject to any disclaimer, the term of this patent is extended or adjusted under 35 U.S.C. 154(b) by 0 days.

(21) Appl. No.: 16/224,180

(22) Filed: Dec. 18, 2018

(51) Int. Cl.
*B26B 3/00* (2006.01)
*B25G 3/30* (2006.01)
*B25G 3/34* (2006.01)

(52) U.S. Cl.
CPC ..... *B26B 3/00* (2013.01); *B25G 3/30* (2013.01); *B25G 3/34* (2013.01)

(58) Field of Classification Search
CPC ..... B26B 3/00; B25G 3/30; B25G 3/34
See application file for complete search history.

(56) References Cited

U.S. PATENT DOCUMENTS 648,265 A * 4/1900 Von Jaraczewski ..... B25G 3/26 30/344
778,860 A * 1/1905 Hodges et al. ..... B26B 3/00 30/343
1,611,886 A * 12/1926 Champlin ..... B26B 3/06 7/158
1,989,225 A * 1/1935 Campbell ..... B25G 3/32 30/342
1,998,044 A * 4/1935 Brown ..... B26B 3/00 30/342
2,879,591 A 3/1959 Bennett
3,201,869 A 8/1965 Gambino
3,481,038 A 12/1969 Cooper
4,418,732 A * 12/1983 Kolonia ..... B25G 1/10 16/436
5,310,230 A * 5/1994 Carmien ..... B29C 66/8322 294/49
5,333,345 A * 8/1994 O'Donnell ..... A46B 5/0062 15/144.1
5,372,053 A * 12/1994 Lee ..... B25D 1/00 81/20
5,385,420 A * 1/1995 Newman, Sr. ..... B25G 3/04 15/145
5,402,578 A 4/1995 Whitman et al.
(Continued)

FOREIGN PATENT DOCUMENTS

DE 4409976 A1 4/1993

*Primary Examiner* — Omar Flores Sanchez
(74) *Attorney, Agent, or Firm* — Cowan, Liebowitz & Latman, P.C.; Mark Montague; Daniel Basov

(57) ABSTRACT

A knife with a hidden tang, and a computerized method selecting the pre-fitted knife parts and assembling them into a customized knife product, based on the consumer's selections including use of a natural material for the knife handle, but without the need for grinding, polishing or processing the pre-fitted parts after assembly.
A knife assembly utilizing a rounded filet surface and a hidden tang for the precise fitting and connection of a butt of a knife tang, handles and a cylindrical back surface of a generally cylindrical blade bolster. A method of assembly of a knife with a hidden tang, using a larger diameter channel in the handle and providing specific geometric requirements for the components in order to accomplish a more precise fit of the pre-ordered components.

9 Claims, 18 Drawing Sheets

(56) References Cited

U.S. PATENT DOCUMENTS 6,209,207 B1 * 4/2001 Patterson ..... B26B 3/00 30/125
6,419,371 B1 * 7/2002 McCalla ..... B25B 23/18 362/109
8,051,570 B1 * 11/2011 Brown ..... A47G 21/005 222/192
D767,935 S 10/2016 Williford et al.
10,377,031 B2 * 8/2019 Wood ..... B26B 3/06
2002/0062567 A1 * 5/2002 Nichols ..... B26B 3/00 30/294
2003/0101598 A1 * 6/2003 Chen ..... B25G 3/00 30/342
2003/0221323 A1 12/2003 DeAsis et al.
2004/0198173 A1 * 10/2004 Shulman ..... A63B 69/004 446/473
2006/0123600 A1 * 6/2006 Morse ..... B25G 1/005 16/421
2006/0288828 A1 * 12/2006 Rondinone ..... A22B 3/10 83/13
2007/0166100 A1 * 7/2007 Congdon ..... B25G 3/30 403/299
2007/0227014 A1 * 10/2007 Loehnert ..... B25G 1/10 30/342
2009/0007434 A1 * 1/2009 Kwok ..... B26B 3/00 30/125
2009/0100683 A1 * 4/2009 Lion ..... B24D 15/084 30/138
2009/0158600 A1 * 6/2009 Ishai ..... B25G 1/00 30/314
2012/0246946 A1 * 10/2012 Kreitz ..... B26B 3/00 30/342
2016/0059404 A1 * 3/2016 Stepp ..... B25G 3/30 30/340
2016/0339591 A1 11/2016 Sung
2017/0057074 A1 * 3/2017 D'Avignon ..... B25F 1/02
2017/0136617 A1 * 5/2017 Lucas, Jr. ..... B25G 1/06
2018/0056530 A1 * 3/2018 Liu ..... B25G 1/00
2018/0056531 A1 * 3/2018 Liu ..... B25G 1/00
2018/0169850 A1 * 6/2018 Reissmann ..... B25F 1/02
2018/0169852 A1 * 6/2018 Fryer-Biggs ..... B26B 3/00
2018/0290032 A1 * 10/2018 Solheim ..... A01K 87/08

* cited by examiner

630

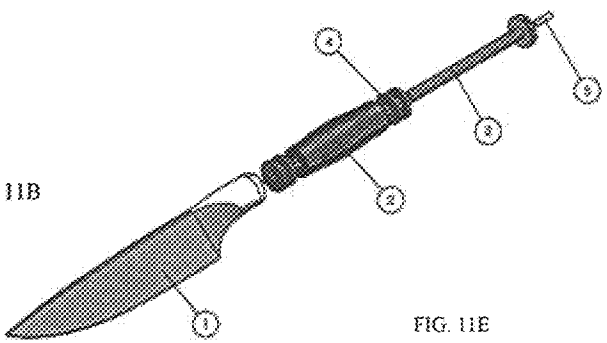
FIG. 11E
FIG. 11B
FIG. 11D
FIG. 11C
FIG. 11A
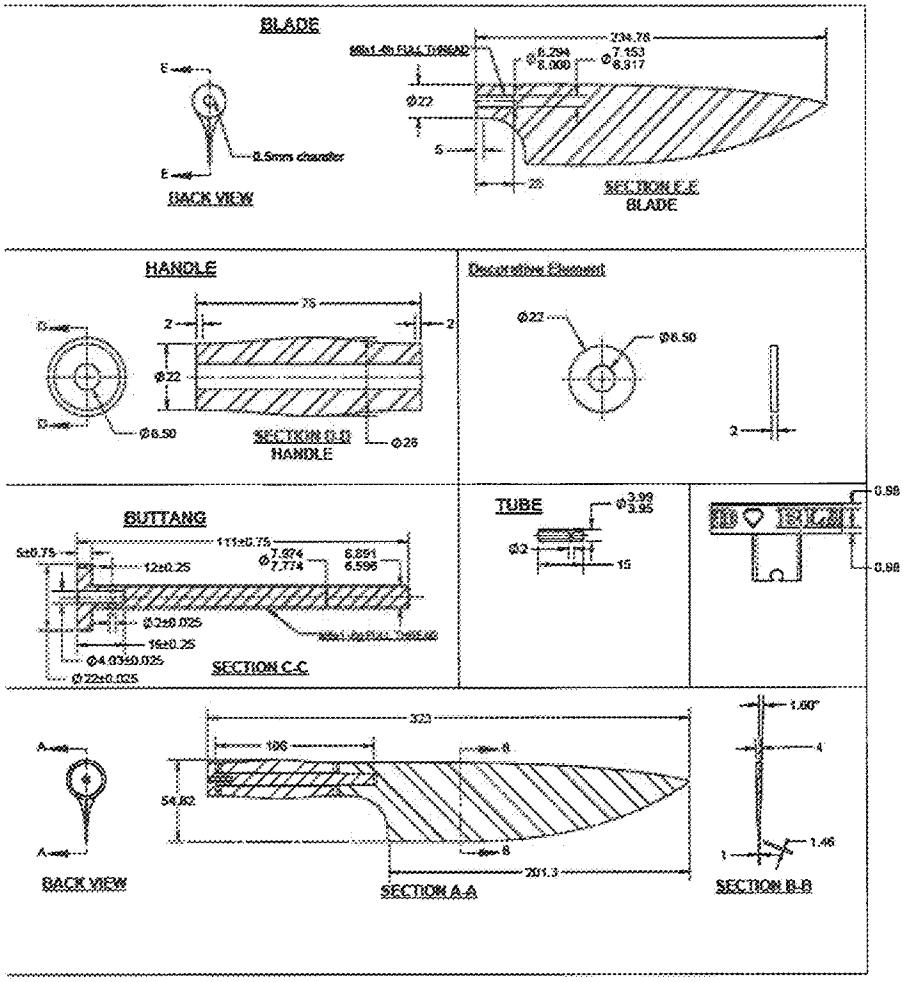

1340

1342

1343

1344

METHOD OF CUSTOMIZATION AND ASSEMBLY OF THE PREFITTED KNIFE

BACKGROUND

Field of the Invention

The present invention relates to the construction and assembly of cutlery instruments, such as knives and knife components, and a computerized system for allowing a consumer or any third party to select pre-fitted knife parts and assemble them into a customized knife product based on the consumer's (or the third party's) component selections. More particularly, the invention relates to a method of selecting and assembling of the pre-fitted knife parts, chosen by a consumer, into a customized knife product with a hidden tang, but without the need for grinding, polishing or processing the pre-fitted parts after the assembly into a customized knife product.

A typical non-folding type of knife is constructed from an elongated metal blade, which has a cutting surface on one end and a tang part extending from the opposite end, with a handle component attached to the tang. Some types of knives also use a bolster at the end that connects it to the handle. The bolster is the thicker part, extending from the blade and connects to the handle. The examples of some known knife components and constructions are shown in FIGS. 1A-B and 2.

Many known knife construction methods utilize a tang that extends from the blade and bolster and connects to the handle. Once the tang is inserted through the handle opening, it must be secured within the handle in order to allow the user to operate the knife safely. In some known knife constructions, the handle can be made from multiple handle parts, which are attached together (and attach to the bolster) by multiple rivets, extending through the openings on a side.

An example of a known riveted version of a knife with a flatter visible bolster, a riveted handle and a semi visible (semi hidden) tang construction is shown in FIG. 1A. The blade 120 has a spine 122 and an edge 125. In the front, the blade has a tip 123 portion, ending in a sharp point 124. The rectangular bolster 130 extends from the heel portion 128 of the blade, extending further as a rectangular tang 140, connected to the handle 150 by multiple rivets 173 through the grooves, and terminating in a butt section 160. A similar known construction, with a flatter rectangular visible tang 140 and a rectangular bolster 130 is shown in FIG. 1B, where the handle 150 is attached to the rectangular and flatter tang 140 with an adhesive (instead of rivets and grooves). The handle can be made of a single or multiple parts, attached to the tang.

Other known constructions do not utilize a bolster, as for example the knife construction described in U.S. Pat. No. 5,402,578. Examples of the known plastic handle knives, without a bolster and with plastic handles, covering a flat tang, are shown in FIG. 2.

SUMMARY OF THE INVENTION

Millions of different non-folding knives are used by consumers for cooking, and often the consumer desire to purchase and make some customized version of their favorite types of cooking knives, or when desiring to give a set of knives as a gift to someone passionate about food preparation. However, because the currently known methods of manufacture and assembly of fine cutlery requires perfect precision, the customization is usually very expensive and requires precise finishing.

Additionally, when consumers (or third parties, other than the consumers) select a natural type of a material for the handle, such as a stone, wood, bone, metal or some other natural materials, the use of these materials in a customized design (for a particular customer) often involves dealing with imprecisions or variations. These imprecisions can be caused by the customization work specified by the user (or a third party, other than the consumer) or may be caused by the naturally occurring imperfections in the material selected by the user for the custom handle.

One of the features of the present invention is the ability to allow a consumer to choose his or her preferred materials for the handle, optionally select one or more decorative rings on the handle and other decorative components in the butt construction, and then quickly and efficiently assemble, or have a third party (other than the consumer) assemble for the consumer, the pre-ordered chosen components into a customized knife, with a fully round bolster and a hidden tang construction.

Another feature of the present invention is the ability to assemble a customized version of a knife from a number of pre-ordered components selected by the consumer and assemble them into a final product that does not require grounding or polishing of the assembled components or the fully assembled customized product after the handle is attached to the blade and bolster.

Another feature of the present invention is to provide a computerized system that allows each consumer (or any third party acting for the consumer) to select his or her preferred materials and components for a customized knife or knife/cutlery set online, order the selected components and quickly and efficiently have the selected components assembled together into a final product. The present invention realizes the efficiency and cost savings to the consumer by providing a method and system for assembly of the individual pre-ordered selected components without the need for grinding or polishing each custom-made assembled item (particularly after the assembly and attachment of the handle to the blade and bolster). For the purposes of this application, grinding and polishing refers to removing imprecisions and variances caused by the customization and assembly process and imperfections due to the choice of a particular natural material, initial shaping and removing machining scratches caused by the initial processing of the materials, as well as the imperfection in the manufacturing of the selected components. It does not mean removal of fingerprints, dirt or accidental scratches.

BRIEF DESCRIPTION OF THE DRAWINGS

The above and other features and aspects of the present invention will become more apparent upon reading the following detailed description in conjunction with the accompanying drawings, in which:

FIGS. 11A-E illustrate the structure and assembly of components in accordance with at least one embodiment.

DETAILED DESCRIPTION

The construction and operation of the invention is explained with reference to at least one embodiment shown in FIGS. 3-18. While some embodiments described herein and depicted in corresponding figures show use of a particular blade shape or type or a particular type of material for a handle, the present invention is not limited to any particular blade shape or type and is not limited to any particular material that can be selected by a consumer and used for customization in accordance the present invention. A person skilled in the art would understand and apply the assembly process and the structure of the present invention to many different types and shapes of blades, used with different knives, and would also use different types of materials for the handle (based on the consumer choice).

Moreover, the invention is not limited to any particular type of a knife and other knifes, with different blades and for different types of use (hunting, fishing, food preparation, cutlery, etc.) may utilize and be produced in accordance with at least one embodiment of the present invention. In addition, a person skilled in the art may apply the structure and organization of the described components to other sharp or cutting products, such as razors, swords, etc.

Figure 1A:
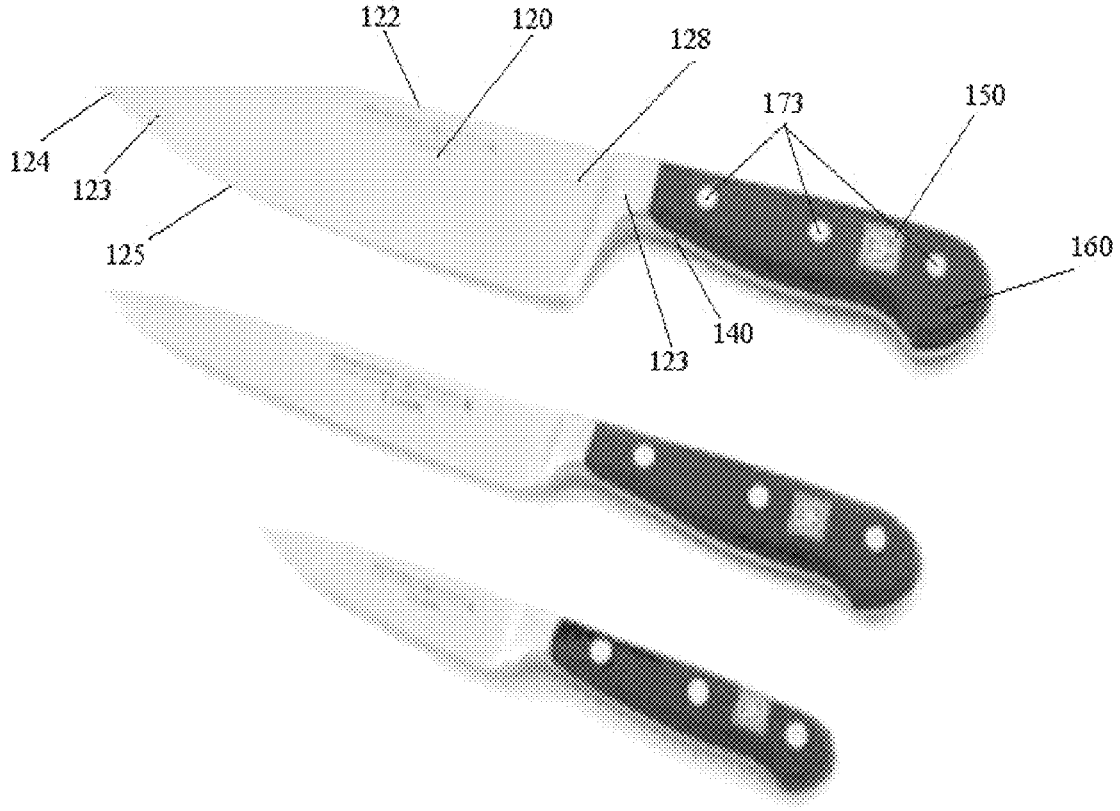
FIG. 1A (PRIOR ART)
FIG. 1A illustrates the components of a riveted knife with a generally rectangular visible tang construction, which is known in the prior art.
Figure 1B:
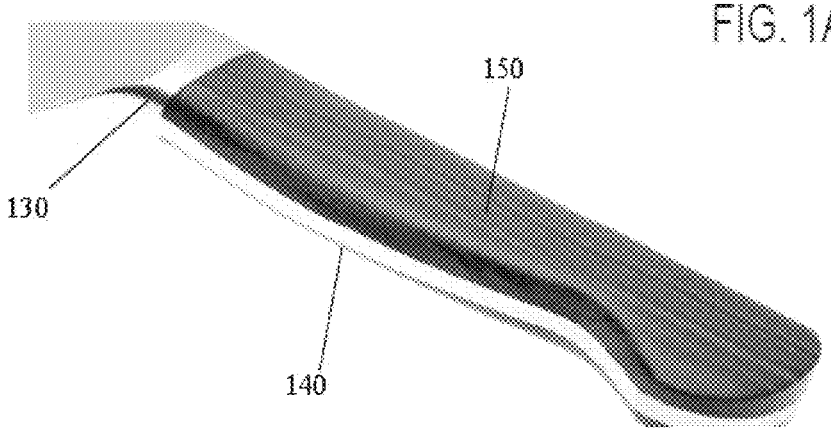
FIG. 1B (PRIOR ART)
FIG. 1B illustrates the components of a knife with a generally rectangular bolster and visible tang, which is known in the prior art.
Figure 2:
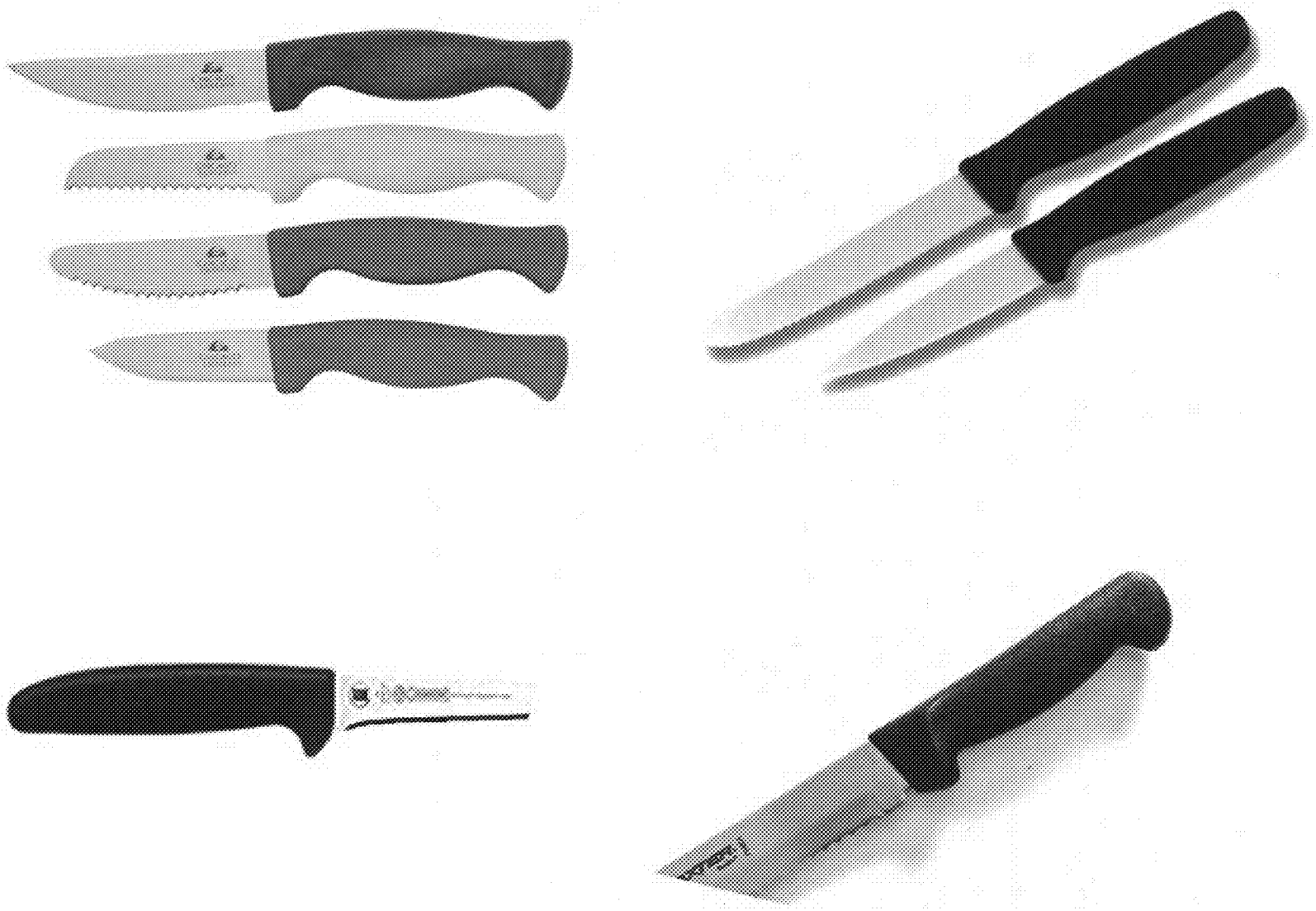
FIG. 2 (PRIOR ART)
FIG. 2 illustrates assembled plastic handle knives, without a bolster, which are known in the prior art.
Figure 3:
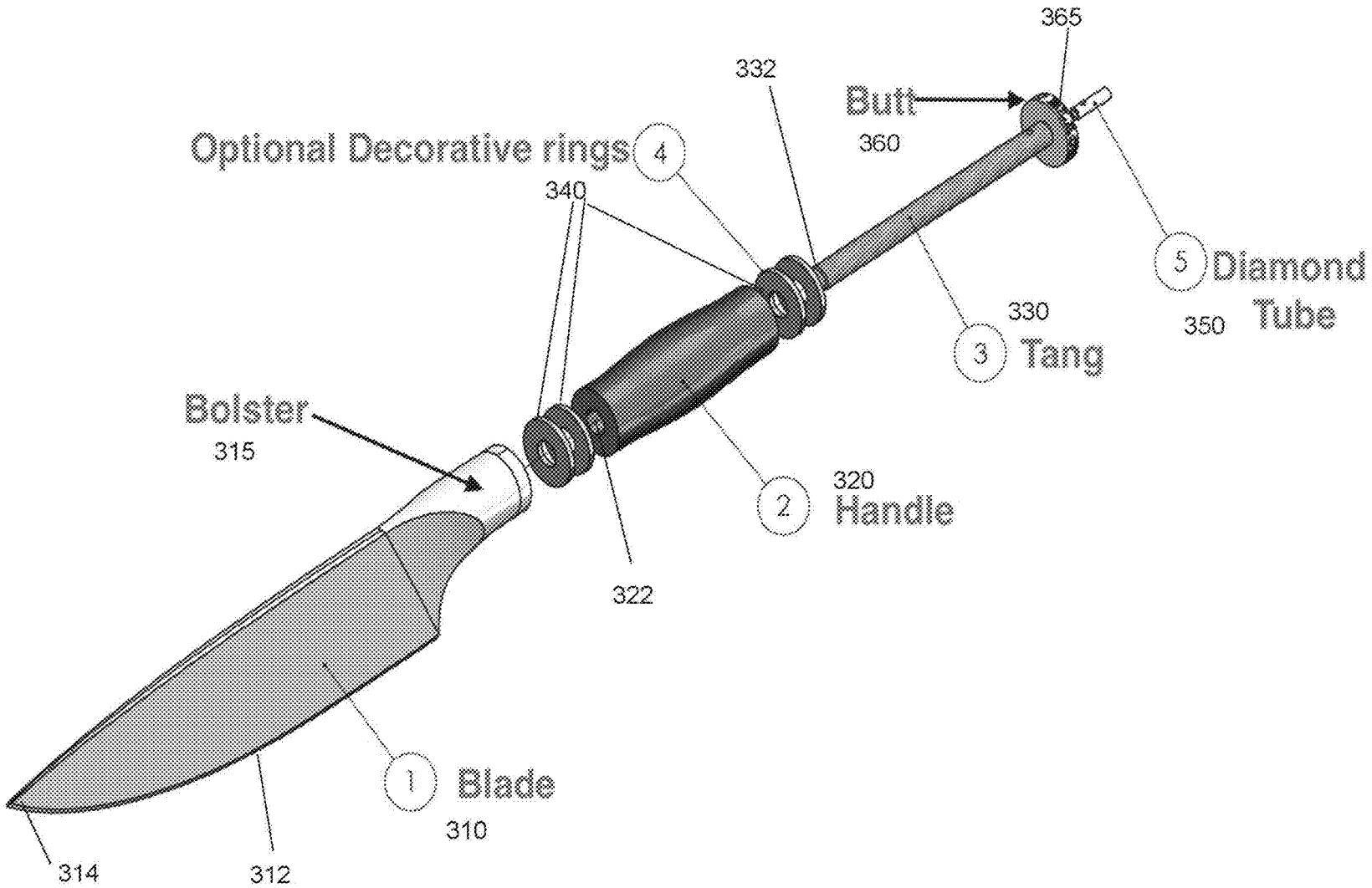
FIG. 3 illustrates the components and structure of a knife with a round bolster and a hidden tang, which is assembled in accordance with at least one embodiment.
Figure 16:
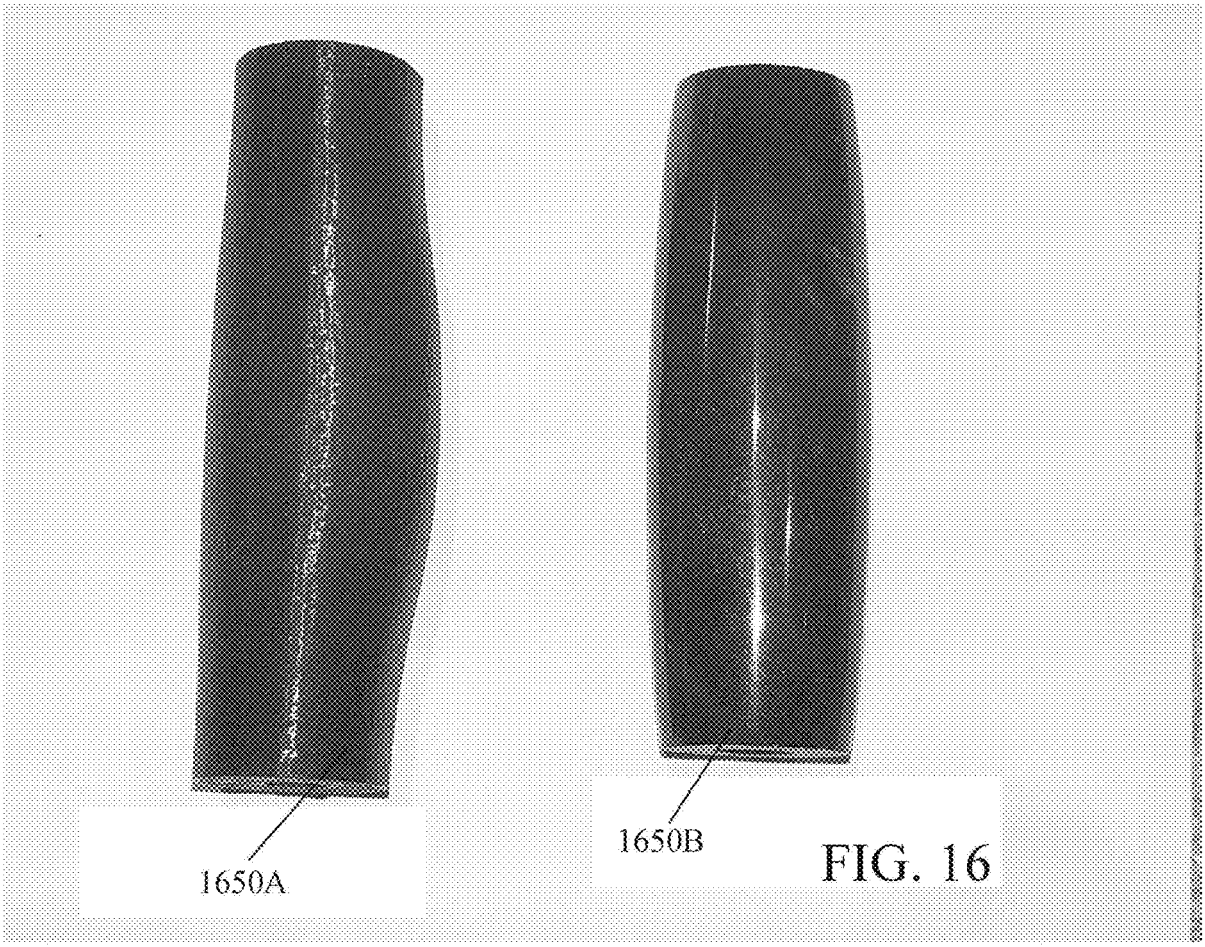
FIG. 16 illustrates different shapes of handles, including a convex cylinder handles, that can be utilized in accordance with at least one embodiment.

FIG. 3 illustrates the components and structure of a knife with a round bolster and a hidden tang, in accordance with at least one embodiment of the present invention. An elongated metal blade 310 has a cutting surface 312 and a sharp point 314 one end. On the other end of the blade, there is a rounded bolster 315, with a gradually sloping areas connecting the bolster to the cutting surface on one end, and forming a round (or near round) convex cylinder on the other end of the bolster 315, at a point of connection to a handle 320. FIG. 16 illustrates different shapes of handles, including a convex cylinder handle 1650A and 1650B, that can be utilized in accordance with at least one embodiment. Other types of handles may also be utilized in accordance with other embodiments.

Figure 9A:
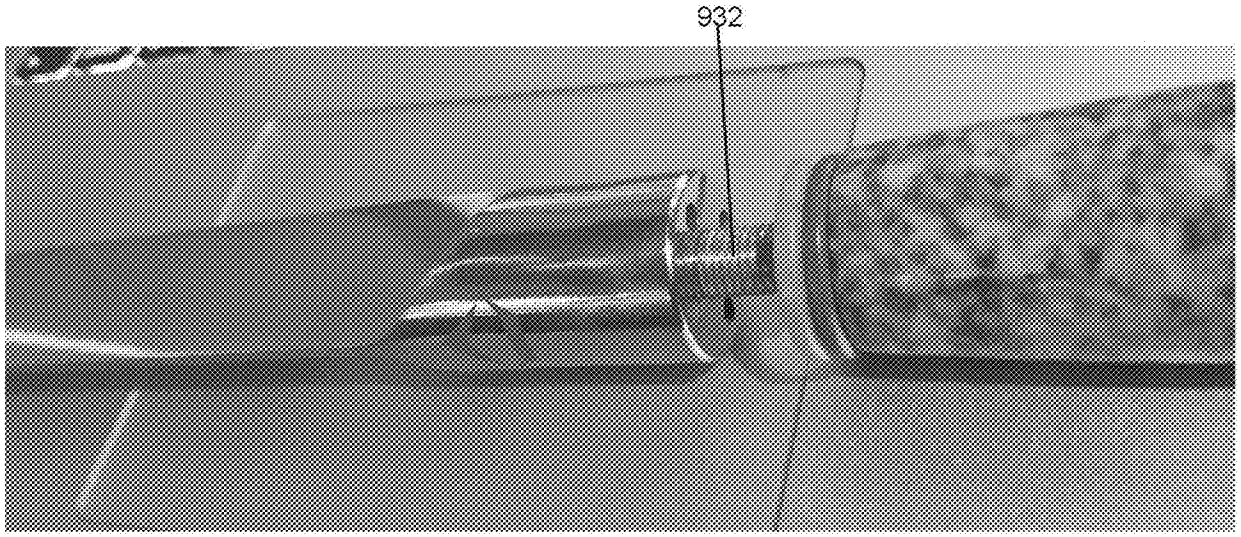
FIGS. 9A-B illustrate the construction, structure and connection of a hidden tang and a bolster in accordance with at least one embodiment.
Figure 9B:
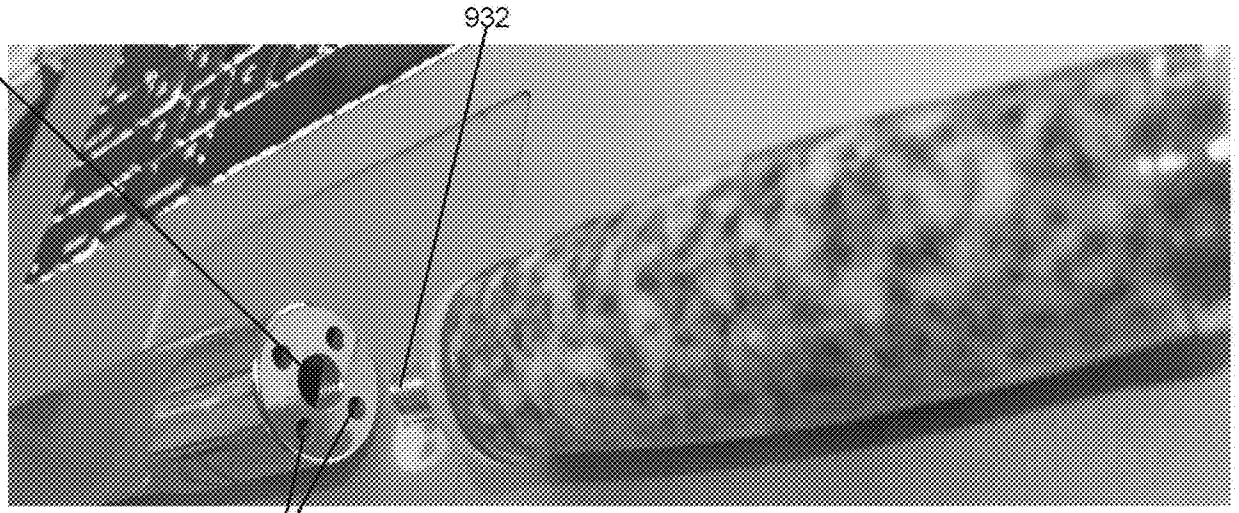

The bolster 315 may have a cylindrical threaded opening of the fitting diameter to accommodate a screw or a threaded bolt 332 of the hidden tang 330. The tang 330 extends through an inner opening 322 of a handle 320, and screws into the threaded inner opening of the bolster 315. The threaded inner opening 917 of the bolster is illustrated in FIG. 9B, and the threaded connection of the threaded bolt 932 of the hidden tang into the inner opening 917 of the bolster is shown in FIG. 9A.

Figure 13A:
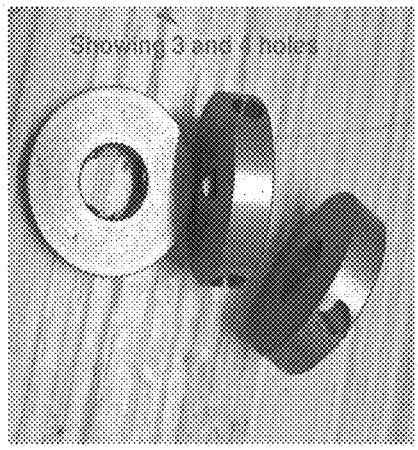
FIGS. 13A-D illustrate the optional rings with inserted stones, engravings and designs that may be used with a knife assembly in accordance with at least one embodiment.
Figure 13B:
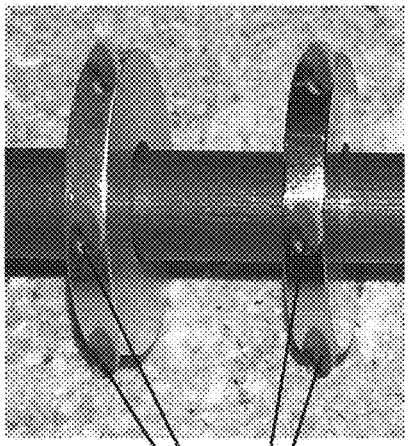
Figure 13C:
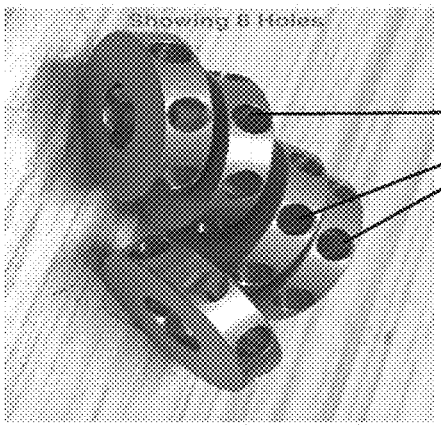
Figure 13D:
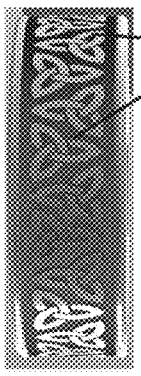
Figure 17:
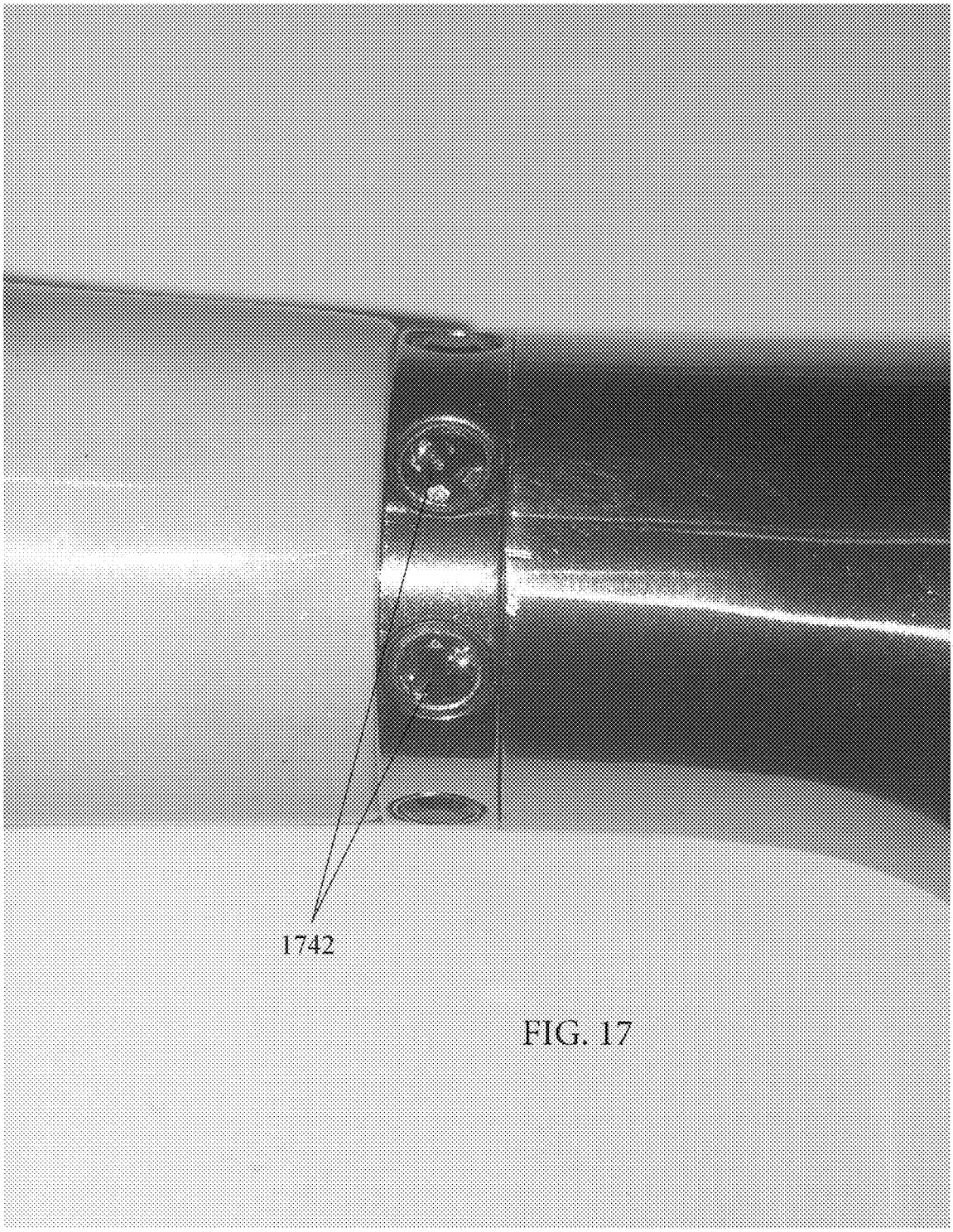
FIG. 17 illustrates faceted stones set into optional decorative rings in accordance with at least one embodiment.
Figure 18:
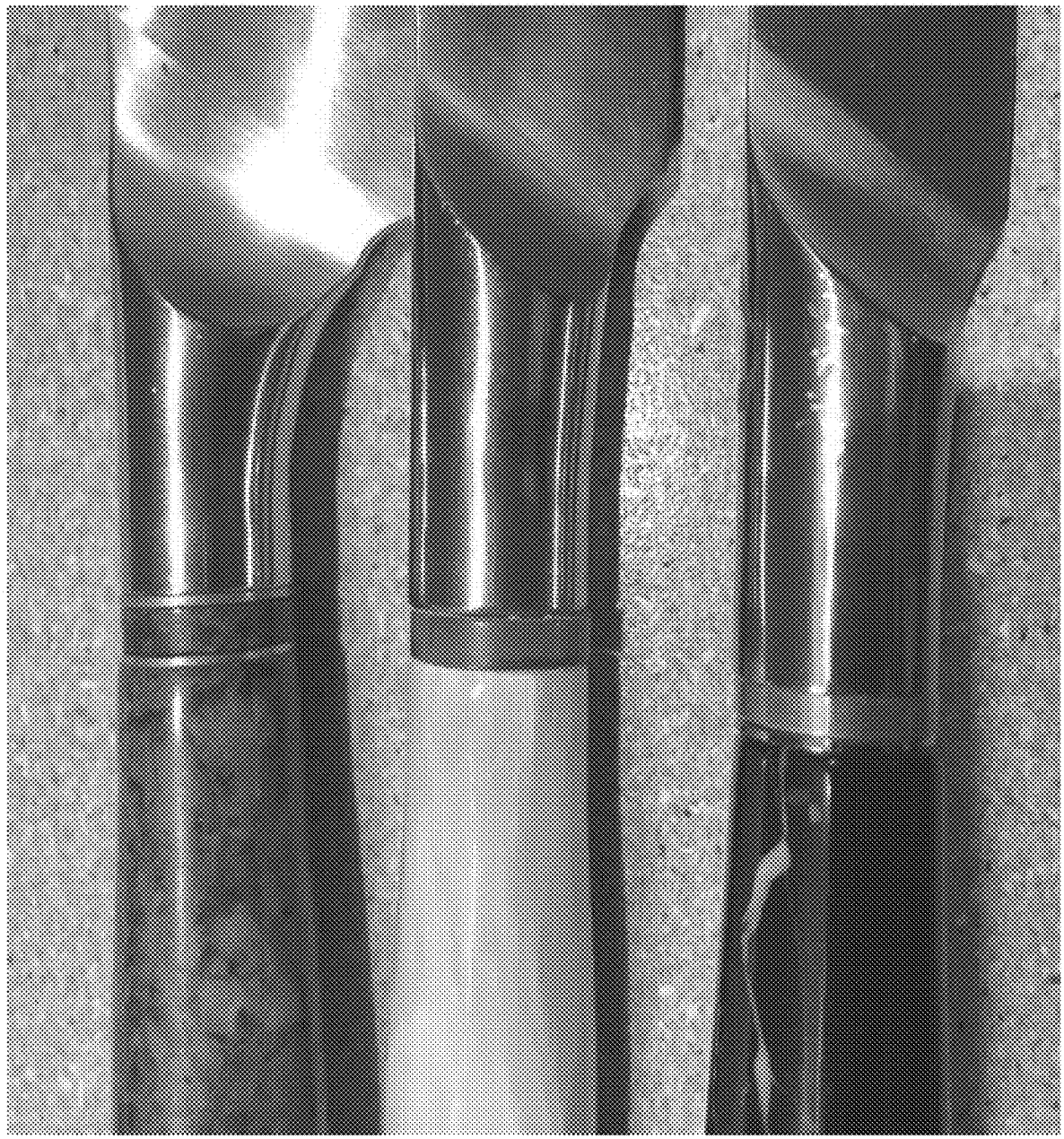
FIG. 18 illustrates use of optional decorative rings without faceted stones.

Referring to FIG. 3, a number of optional decorative rings 340, with tubular opening at the center, may fit onto the tang 330, either between the handle 320 and the bolster 315, or between the handle and a cylindrical butt 360 of the tang 330, or in both places. A decorative ring or multiple rings may be flat or have any combination of engravings, etchings and/or stones (preferably inserted flush with the surface) on a side. The examples of decorative rings with set stones and engravings (or etchings) that may be utilized in at least on embodiment of the present invention are shown in FIGS. 13A-D. FIG. 13B illustrates a number of stones 1342 set in the holes or cavities 1343 in the ring's outer circumference. An example of an engraving or an etching 1344 on the outer circumference of the ring is shown in FIG. 13D. The setting of multiple faceted stones 1742 into one or more optional ring is shown in FIG. 17. The use of flat metal rings (without faceted stones) and use of a solid stone rings is shown in FIG. 18.

The hidden tang 330 (shown in FIG. 3) has a threaded end 332, extending through the inner openings of the decorative rings 340 and the openings 322 of the handle 320, fitting and connected into the threaded inner opening of the bolster 315. The hidden tang 330 also has a butt closure 365, which fits over the handle 320 or over the optional decorative rings 340 between the handle and the butt closure 360. The butt 360 and the tang 330 may have an inner channel, cavity or opening, with a smaller diameter than the diameter of the tang 330, which accommodate a cylindrical diamond tube 350. The diamond tube 350 may either be threaded into the cavity or glued (for example with Loctite). It can also be hammered in under pressure or force, pined or welded through the air release/welding hole 837 in the side of the tang, as shown in FIG. 8C. The welding may be done using an Arc welding method. There may be multiple air release/welding holes utilized in the side of the tang. The air release hole (or multiple holes) serves a dual purpose of releasing the air and as a location to weld the diamond tube in place.

Figure 6A:
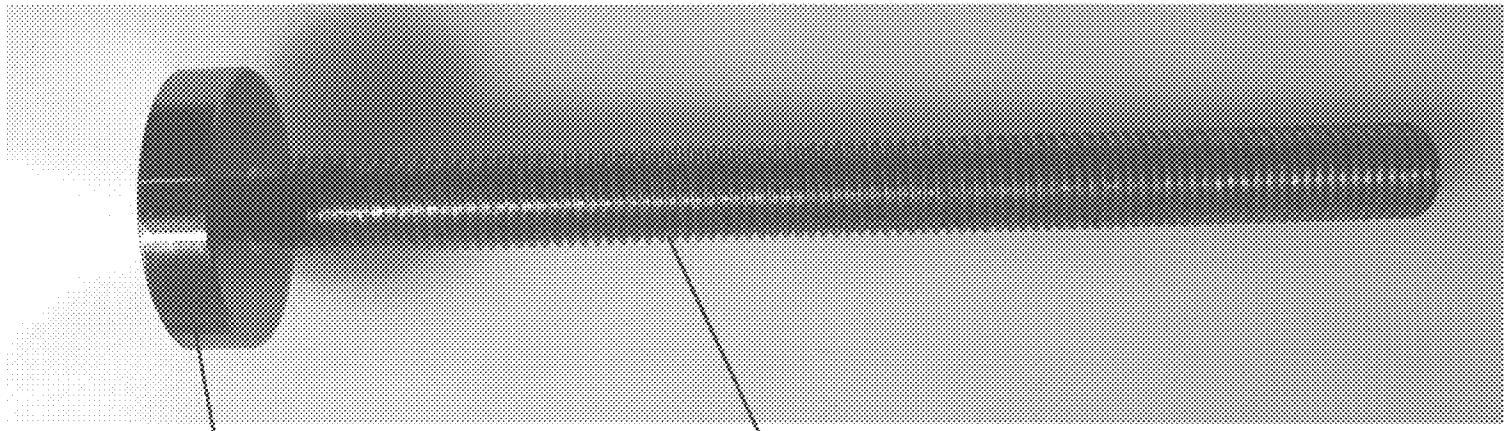
FIGS. 6A-B illustrate the construction and structure of a hidden tang in accordance with at least one embodiment of the present invention.
Figure 6B:
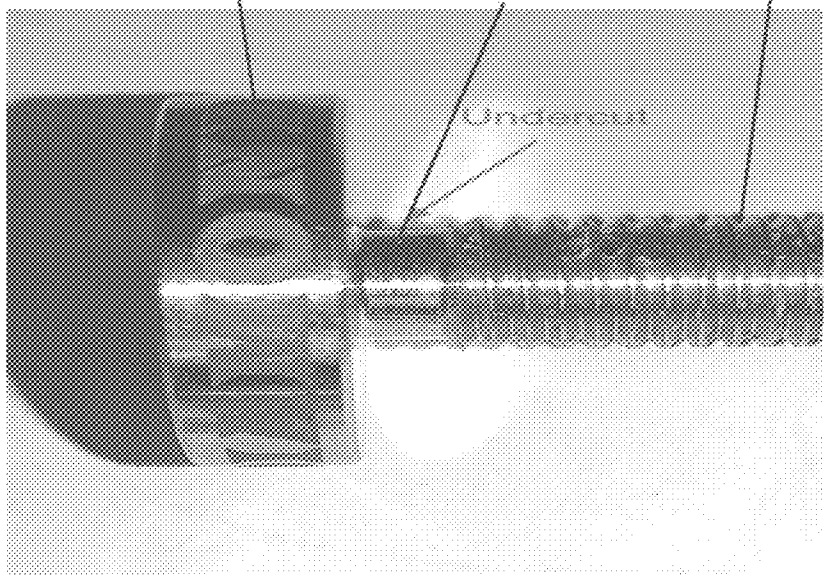

A structure of a hidden tang 630, constructed in accordance with at least one embodiment of the present invention is illustrated in FIGS. 6A and 6B. The hidden tang has a cylindrical butt closure component 665, a threaded bolt 662 and an undercut section 663 at the junction of the threaded bolt and the butt closure. The threaded bolt 662 extends through the inside (hidden) opening drilled though the rounded handle and optional decorative rings of the knife constructed in accordance with at least one embodiment of the present invention. The undercut ensures that the entire bolt does not have a diameter that is greater than the major diameter of the thread (the outside tips of the thread). Furthermore, in accordance with at least one embodiment, the hidden tang may not have an undercut, so long as the bolt diameter closest to the butt part does not have a diameter that is greater than the rest of the threaded bolt of the hidden tang.

Another aspect of the present invention is a computerized system that allows a user (consumer) to visit a manufacturer's (or seller's) webpage and select different components for a knife, designed according to the consumer's selection. Among other selectable options, the consumer can select a blade type (shape and material), handle material for at least a part of the handle (ex. stone, wood, bone, metal), optional decorative rings between the handle 320 and the bolster 315, optional decorative rings between the handle 320 and the cylindrical butt closure 365. The selected optional rings 340 may have engravings, etching and/or inserted stones on the side surface of each ring, which may be selected or designed by the user, to create a more personalized product. One or both sides of the blades can be engraved with images or text.

The examples of different types of optional rings that may be utilized with the present invention are illustrated in FIGS. 13A-D. A knife construction may include one or more optional rings 1340, equipped with multiple cavities 1343 into which multiple stones may be inserted. A ring or multiple rings may also have any combination of engravings, etching and/or designs 1344 on the outer surface. The specific combination of the optional rings and the desired structure and design for each ring may be selected by the consumer, when ordering the pre-manufactured components for the knife assembly in accordance with at least one embodiment.

One other aspect and feature of the present invention is the ability to utilize finished parts and components, selected and designed by the customer, and assembled together into a finished knife without the need to grind or polish the components or the final assembled product in order to perfect the fit and get rid of the sharp edges and overhanging surface between the knife handle and the bolster, and the handle and the butt closure (with or without optional rings). The grinding and polishing operation adds to the expense for each customer, and also takes a lot of extra time for the customization work to be completed, before the final product may be shipped to the purchaser. Furthermore, it requires a skilled craftsman to work on the final product for each customer; the cost that is typically translated into a much higher price for the consumers.

Moreover in traditional methods of custom making knives, when each knife is customized, fit, then ground and polished for a consumer, that customer can't change his or her mind after the customization and fitting is done, and the customization work has commenced. Thus, the consumer is committed to purchasing the selected components. The present invention allows more flexibility in the selection of the components and assembly that is both more efficient, faster and has much lower overhead and customization fitting costs. It also allows the consumer to make quick last minute adjustments and modification, without having to redo the customization work and fitting all over.

Figure 8A:
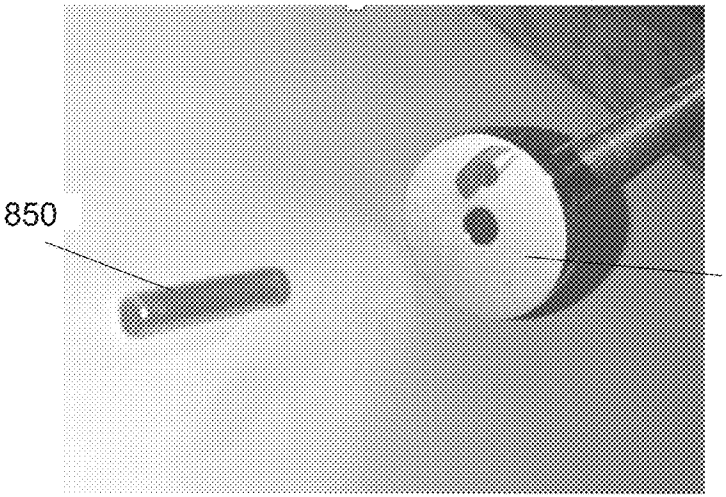
FIGS. 8A-D illustrate the construction and structure of a tang butt, butt closure and diamond tube components in accordance with at least one embodiment.
Figure 8B:
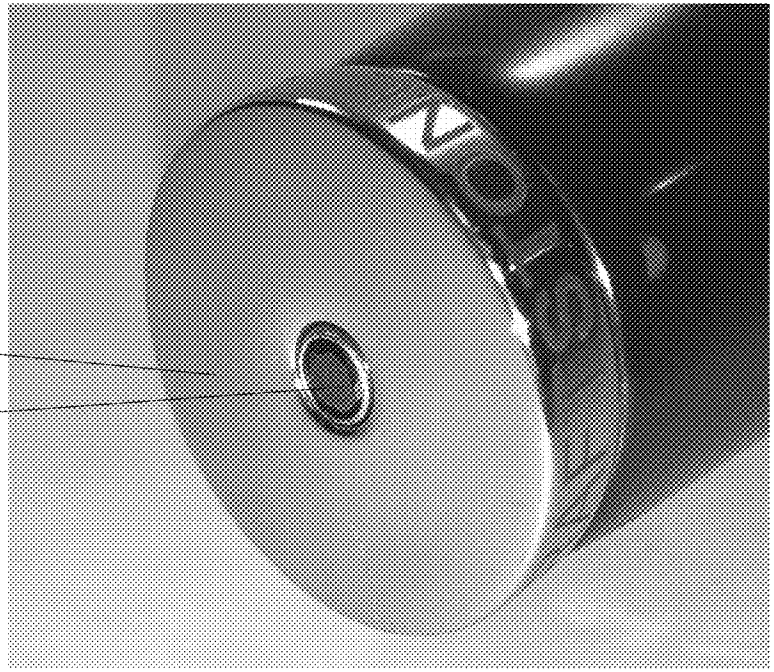
Figure 8C:
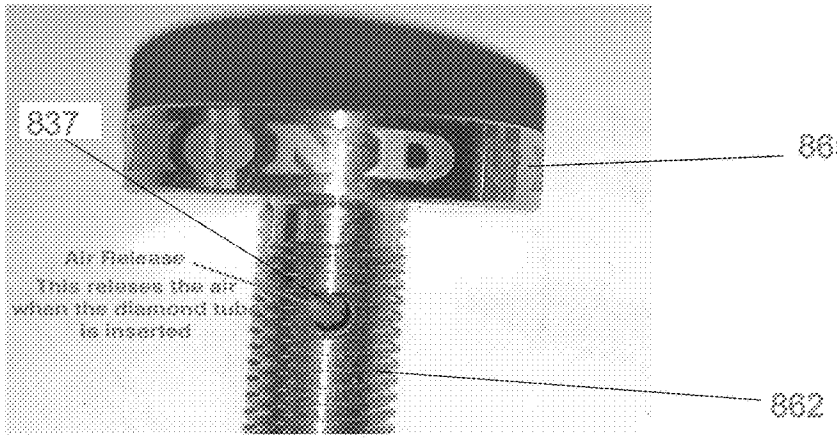
Figure 8D:
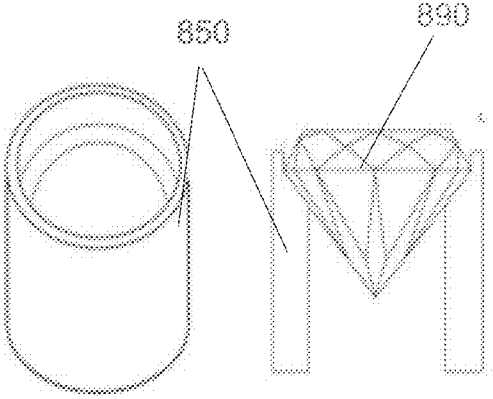
Figure 15:
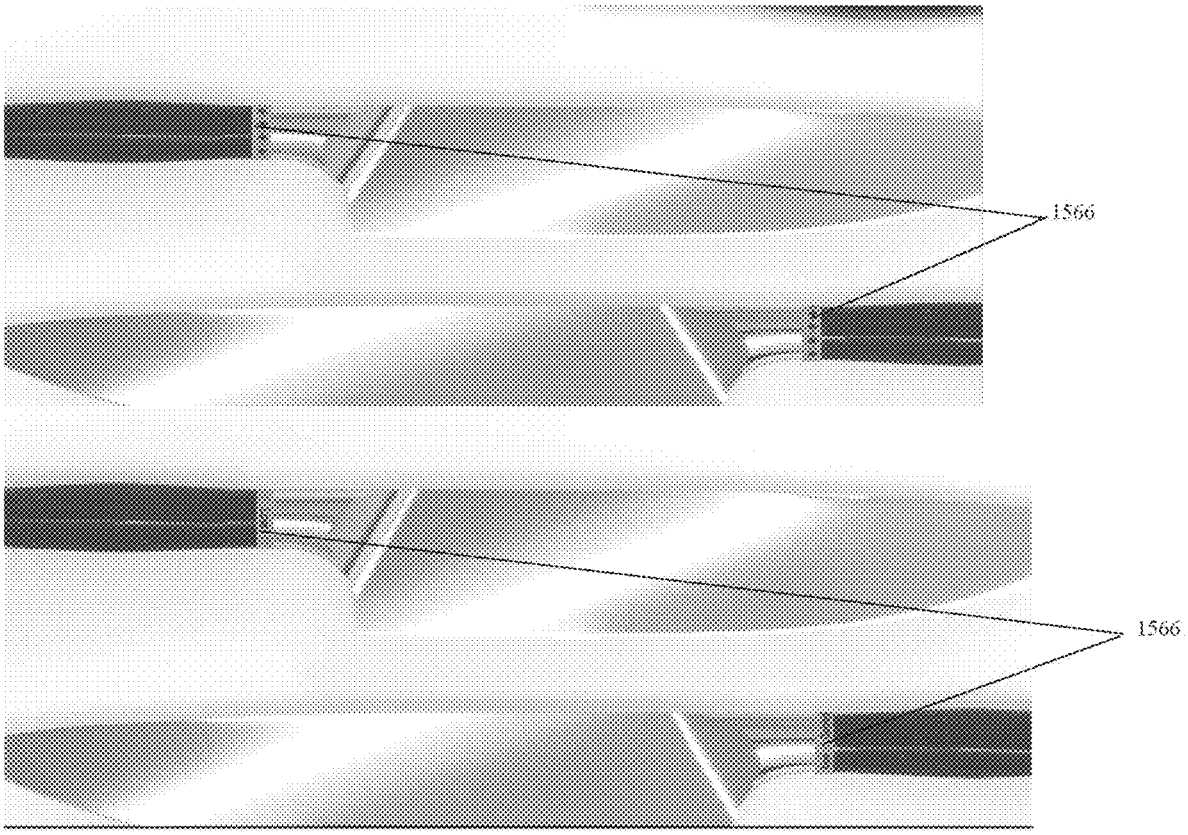
FIG. 15 illustrates examples of different type of engravings on the decorative rings in accordance with at least one embodiment.

Referring to FIGS. 8A-D, the user may select a particular faceted stone that fits into a diamond tube 850 and within the butt closure 865. A stone or diamond (real or imitation) 890 may be set within a cylindrical diamond tube 850 as shown in FIGS. 8A-D. FIG. 8A illustrates the diamond tube 850 fitting within an inner cavity of the butt closure 865. The tang 862 may have one or more air release/weld openings 837, which are needed when the diamond tube 850 is inserted into the narrow channel or cavity of the butt enclosure 865 and extends inside the inner cavity within the tang 862. The butt closure 865 may have a logotype, brand name or a trademark engrave on the outer surface. Examples of different type of engravings 1566 on the butt closure are shown in FIG. 15.

The air release/weld openings 837 are necessary because the diamond tube 850 may be press fit into the cavity of the butt enclosure 865. Therefore, the air would become compressed and not allow the insertion of the tube without an appropriate air release opening or cavity. Furthermore without the air release, a small amount of air might be forced out of the cavity of the butt closure (and tang). This might be problematic since the diamond tube is adhered to the cavity in the butt closure with a thread locker, which is an anaerobic adhesive (it works when there is no oxygen present). The use of one or more air cavities in the threaded tang avoids these problems.

The setting of the stone may be done using the traditional stone setting tools that are used to insert stones into a bezel settings. Once the stone is set, then the diamond tube and all surfaces of the tang are cleaned using a rubbing alcohol, and are allowed to dry. Then, the diamond tube 850 is fit into the cavity in the butt closure 865 and the tang 862 using Loctite or another anaerobic adhesive for secure fit, as illustrated in FIGS. 8A-D.

Figure 5A:
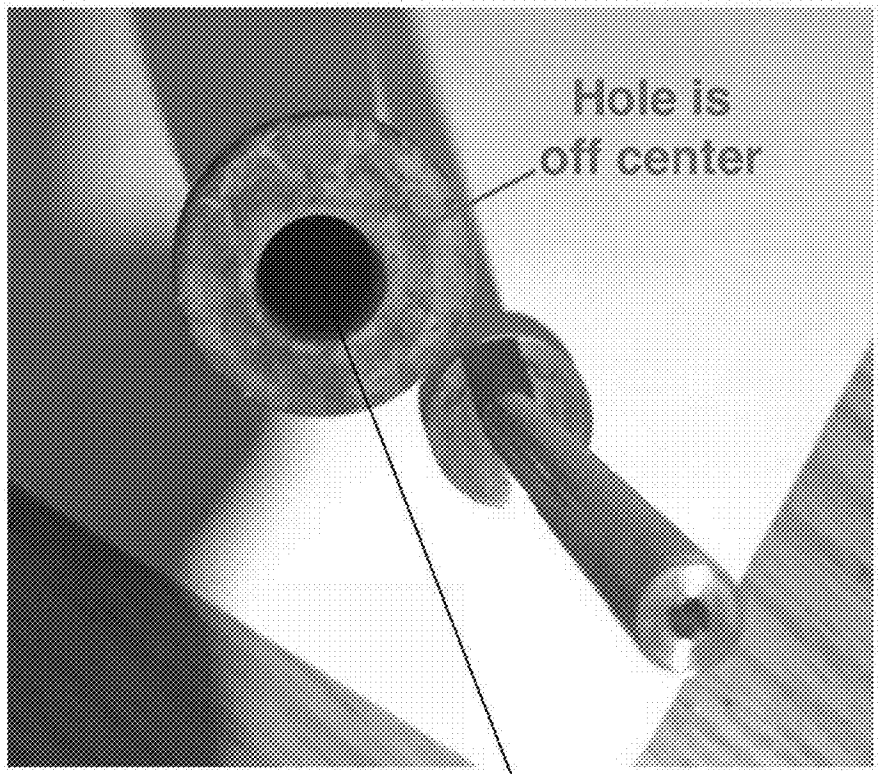
FIGS. 5A-B illustrate various fit problems that occur with the pre-ordered components, the problems addressed and resolved in at least one embodiment described in the specification.
Figure 5B:
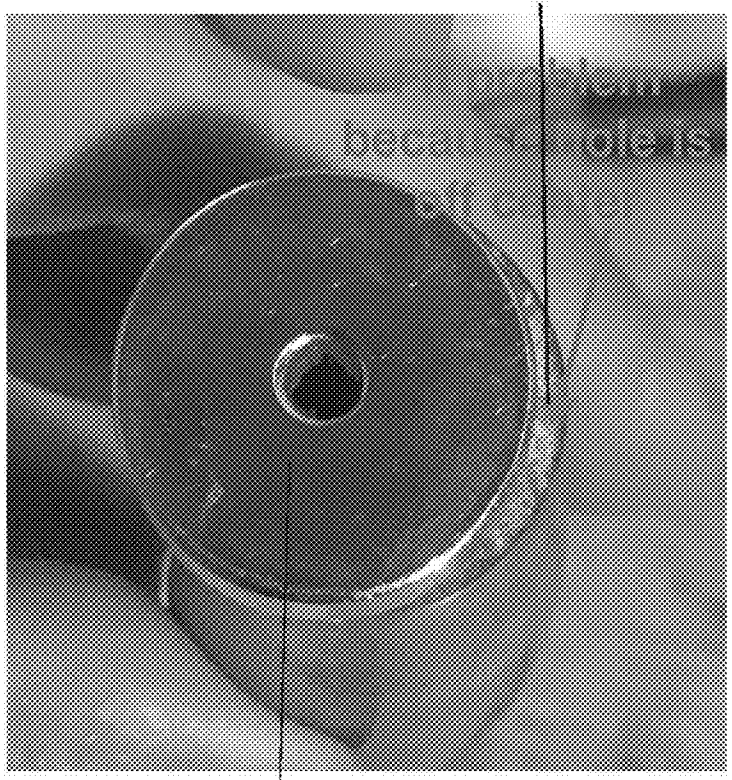

The present invention resolves a number of common problems that typically result from the use of pre-made components and also use of the natural materials, such as wood or stone for the handle. FIGS. 5A and 5B illustrate some common fit problem that may arise with the use of pre-manufactured components. These common fit problems typically require customized fitting by grinding and polishing of the knife after assembly to address each illustrated problem. The fit problems shown in FIGS. 5A and 5B are resolved by at least one embodiment of the present invention.

FIG. 5A illustrates a problem when the drilled hole in the handle 520 is drilled slightly off center. Due to the fact that each part is made separately, there are size tolerances inaccuracy in the manufacturing process, especially with natural materials like stone and wood that are selected for the handle, as well as the optional rings that may also made out of stone, wood or some other natural material. The junction of all the "adjacent parts" (the back flat part of bolster, the ends of the handles, the rings and the butt may be specified and set to 21.80 mm, in accordance with at least one embodiment.

However, when the actual parts come back from the manufacturers, the handle ends may have a size tolerance of as much as +/−1.5 mm (metric). While this is not a large measure by the human eye, it creates a sharp edge between the edges of the different materials. In other words, if the back of the metal bolster was 21.80 mm, but if the handle was 20.50 mm, there would be a sharp edge or a step between the two parts, and the square corners of the parts would feel sharp to the user's hand while he or she held the knife.

Figure 4A:
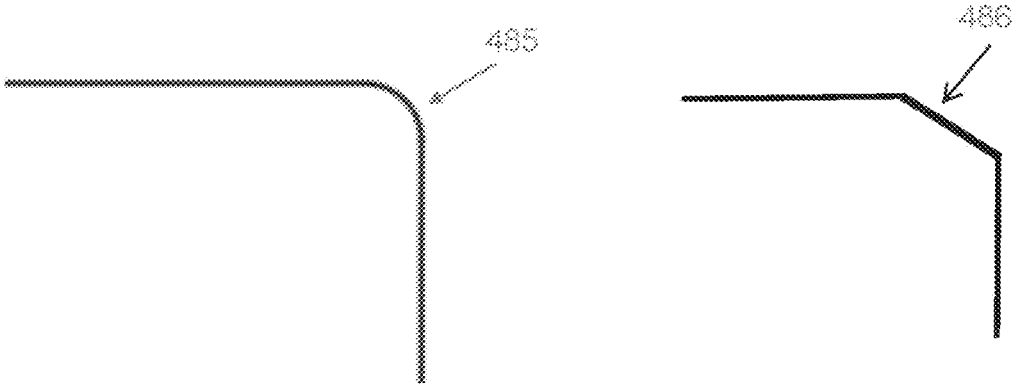
FIGS. 4A-B illustrate the shape and use of a rounded filet in accordance with at least one embodiment.
Figure 4B:
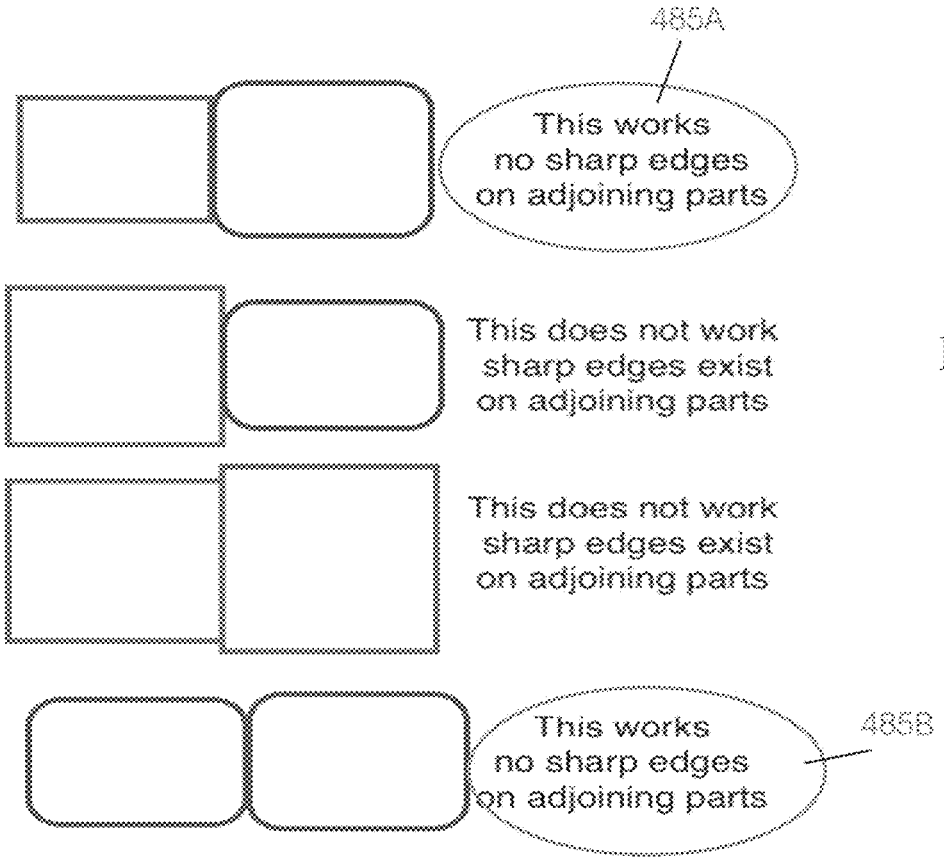

One way that the present invention deals with the above issues is by adding a 0.5 mm "filet", a rounded edge 485 shown in FIG. 4A, to the corners of all the adjacent parts. In another embodiment, a chamfer shape 486 can be used instead of a filet, as shown in FIG. 4A. In this application, the reference to a "filet" shape includes the filet and chamfer shapes, as well as other variations and shapes that have rounded rather than sharp edges. The filet size may vary, particularly when used with the stone and wood handles, and with stone rings. The combination of the adjacent parts, and how the rounded filet 485 resolves the issues with the variances in the size and sharp edges (or steps) is illustrated in FIG. 4B. The use of the round filet, shown in the top and bottom combinations 485A and 485B of the handle and other elements (in FIG. 4B) illustrates the solution and the filet arrangement utilized by the present invention in at least one embodiment. By implementing a rounded filet as a fit solving solution for the knives assembled from the pre-manufactured components, the present invention removes the need to perform customized fitting, grinding and polishing of the edges, to adjust for size variances and to remove sharp edges.

FIG. 5B, illustrates another problem that happens with the use of natural materials, such as stone or wood for the knife handle. Drilling a long hole/opening throughout the length of the handle often presents a difficult challenge. The drilling operation may start perfectly in the middle, but continue to drift slightly off center by the time the hole is drilled through approximately 90 mm length of the handle. As illustrated, when the handle with an opening that is slightly off center is fitted against the butt closure 565, there is a sharp edge or lip 599 formed between the handle and the butt closure 565. Similar problem happens when an opening that is slightly off center is fitted against the bolster side. In the known knife constructions, this requires a customized fitting of the final product, where the sharp and protruding edge is ground and the remaining combined components are polished, to clear the surface and connection.

The present invention utilizes a particular method for resolving these problems and also being suited to utilize pre-manufactured components, which typically will have higher level of variances. For example, the tang may have an outer diameter of approximately 8 mm, and the diameter of the opening inside the handle may be approximately 8.5 mm. In order to deal with the off center variances, the present invention utilizes a larger diameter opening, approximately 9.0 to 9.5 mm. This allows the tang to fit correctly and the edges to align properly at the junction of the tang closure and the rounded end of the handle.

At least one embodiment of the present invention applies the following methodology and geometric requirements to the pre-manufactured components:

(a) The diameter of the back of the bolster (closest to the handle) is required to be identical or near identical to the diameter of the end of the handle that attaches to the bolster;

(b) The diameter of the butt closure component that attaches to the handle is required to be identical or near identical to the diameter of the end of the handle that attaches to the butt;

(c) The edges of all adjacent parts are rounded (see FIGS. 4A and 4B), and can stay on center when they are rotated;

(d) The butt and butt closure must be perpendicular (or nearly perpendicular) to the tang;

(e) The flat back side of the bolster must be parallel or nearly parallel to the butt closure;

(f) The threaded hole in the bolster must be perpendicular or nearly perpendicular to the flat backside surface of the bolster;

(g) The threaded hole in the bolster must be perfectly (or nearly perfectly) in the middle; and (h) The back of the bolster, handle ends and the inside of the butt closure must be parallel (or nearly parallel) to each other and preferably flat.

These "geometric requirements" may be applied to the pre-manufactured components in order to assure a more perfect fit of the components when assembled. Some of these geometric requirements are further illustrated with reference to FIG. 12. Furthermore, the failure to adhere to the geometric requirements, such as having the openings in the connecting components not being mostly parallel to each other, and the tang and threaded bolster holes not being perpendicular to the axis of the handle, could prevent the components from fitting together at all, and/or may leave large gaps between the connected parts. This would mean that the assembled components might be wasted as being defective and unusable, or require extensive and expensive custom fitting.

In accordance with at least one embodiment, the geometric requirement R1201 is that the diameter of the round back part 1215 of the blade bolster, which connects to the handle, must be 21.80-22.00 mm+/−0.1 mm in variance, or preferably less. This size accommodates and matches the diameter of the end of the handle and the butt cover 1265, which also have diameter requirement of 21.80-22.00 mm. These specified sizes may vary. For example, the metal parts, such as the bolster and butt could vary by +/−0.025 mm, and the handles and rings could vary by +/−1.5 mm in accordance with at least one embodiment.

The geometric requirement R1202 is that the center hole 1216 in the bolster, which accommodates the threaded hidden tang 1230 is perfectly (or nearly perfectly) in the center of the bolster 1215. The geometric requirement R1203 is that the axis of the hole 1216 in the bolster must be perpendicular (or near perpendicular) to the back of the bolster.

The geometric requirement R1204 is that the opening in the bolster 1215 must be at least 25-27 mm deep and must be able to receive and accommodate an M8 1.0 hidden tang 1230. The actual sizes of the tang and bolster opening may vary, so long as they correspond and interrelate to one another as described. The 27 mm opening in the bolster will extend the bolster, and it may function like an extension of the handle. The taped thread may go to at least 25 mm in depth, or as little as 16 mm in depth depending on the number of decorative rings and the exact length of the handle in at least one embodiment of the present invention.

The geometric requirement R1205 is that the back of the bolster and the near end of the handle is the matching curvature and angle, and that the other end of the handle and the inside of the butt that connects to the handle must also match the curvature and angle of curvature. In the embodiment shown in FIG. 12, they are shown as parallel to each other. The geometric requirement R1206 (not shown) is that the handle should not curve down from the blade, and should be centered along the same axis as the bolster opening.

The geometric requirement R1207 (not shown) is that the edges of the bolster, the corners of the handles and the inside of the butt closure surface (attaching to the handle) must have a rounded filet surface (as indicated in FIGS. 4A-B).

In at least one embodiment, other optional geometric requirements may include the requirement R1208 (not shown) of at least 3 mm clearance between the bottom of the bolster opening to the blade side of the bolster 1215 that joins to the blade 1210; the requirement R1209 that the bottom of the bolster must be at least 5 mm higher than the edge of the blade, to allow for easy sharpening; and the requirement 1210 that the bolster include a curved sloping shape 1216*a* from the round part of the bolster that connects to the handle, and another sloping shape 1216*b* from the bottom of the bolster toward the blade edge.

As discussed above, in addition to the above geometric requirements, the present invention may also utilize a rounded filet component and a larger diameter opening within the handle in order to secure the components and avoid the need to perform grinding and sanding operations and other customization work on the assembled product.

Figure 7A:
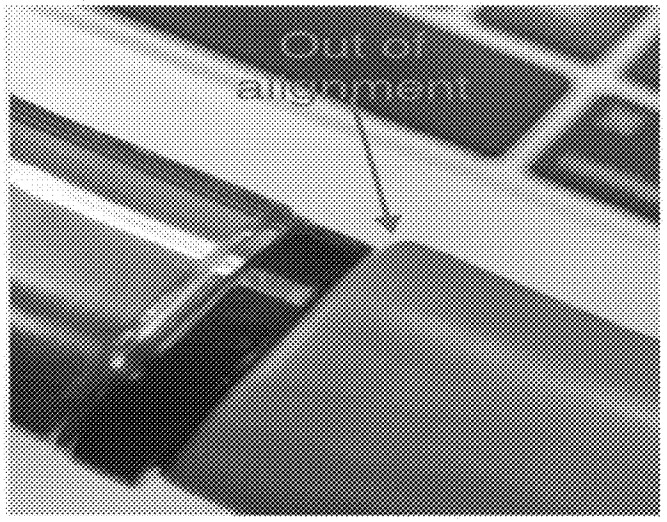
FIGS. 7A-C illustrate the use of clamps in resolving various alignment problems with the pre-ordered components in accordance with at least one embodiment.
Figure 7B:
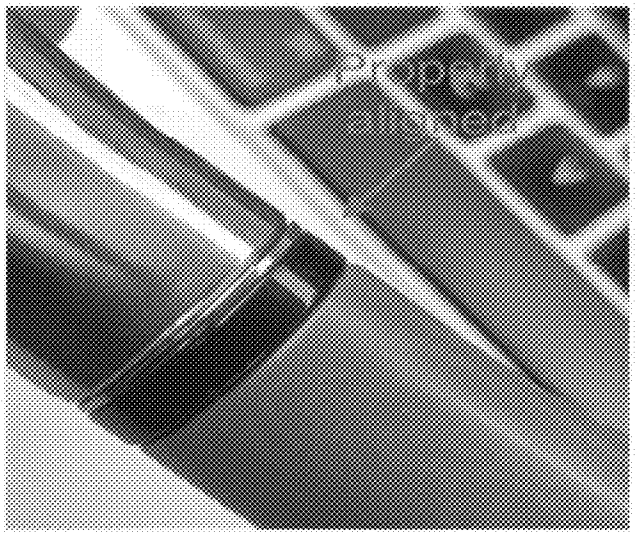
Figure 7C:
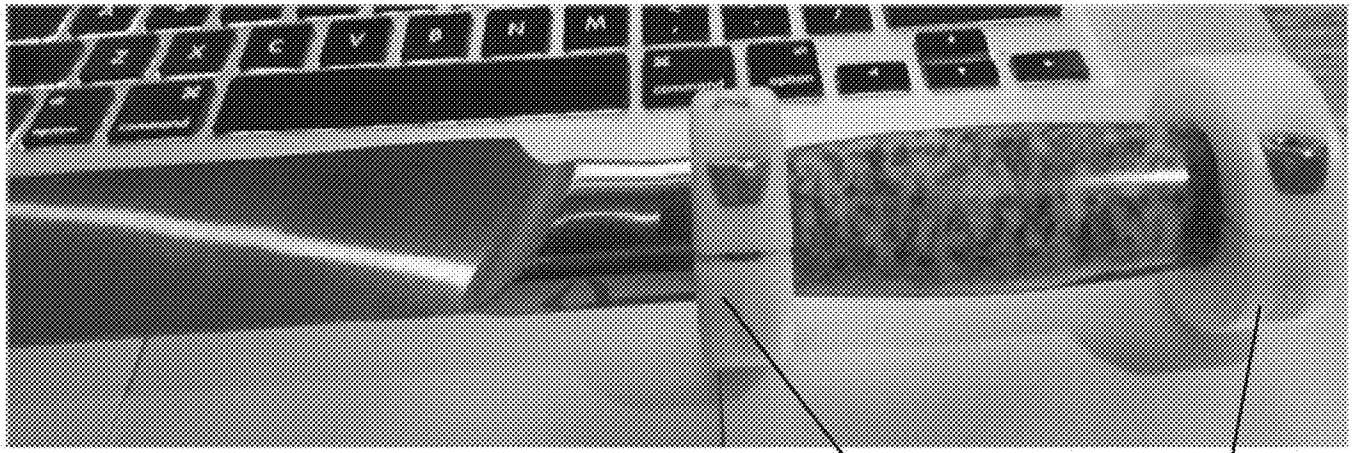

The fitting of the bolster and the handle in accordance with at least one embodiment of the present invention is described with reference to FIGS. 9A and 9B. FIGS. 7A-C further illustrate the use of a glue assembly process in accordance with at least one embodiment of the present invention. The back of the bolster preferably has multiple holes 917, which allow the handle and the bolster to be assembled with an epoxy glue attachment. The glue flows into the holes 917 during the gluing assembly. When the glue dries, it adds to the strength of the assembly, keeping the threaded screw or bolt part 932 of the tang firmly connected with the inner threaded opening 917 in the bolster.

In order to ensure that the handle, the blade, bolster and the tang all stay mostly on center and do not move during the glue assembly operation, the present invention utilizes clamps, as illustrated in FIGS. 7A-C. As discussed above, the cavity or opening in the handles and the decorative ring openings may have larger diameter than the threaded tang, and may sometimes be off center.

The larger diameter holes in handle and in the decorative rings allows these parts to be aligned back on center, with the use of the clamps 788*a* and 788*b* during glue assembly, as shown in FIGS. 7A-C. The two or more clamps 788*a* and 788*b* are used to hold the handle, the hidden tang inside, bolster and the butt closure (with or without optional rings) in a mostly on center alignment during the gluing process and while the glue dries and hardens. One clamp could also be used instead of two or more, if one junction is perfectly centered, and the claim is placed at the other junction for the alignment. Thus, when the components are out of alignment, as shown in FIG. 7A, the use of the clamp(s) and the larger openings properly shifts them into alignment, as shown in FIG. 7B.

The clamps utilized with the at least one embodiment are not used for the usual purpose of holding the components together, but to align the components in accordance with the requirements set forth above, during the glue assembly. The clamps 788*a* and 788*b* can be made of HDPE plastic, or any material to which an adhesive used for assembly, such as, for example an epoxy glue, does not adhere. Therefore adhesive that may overflows when the parts are assembled will not stick to the clamps.

Figure 10:
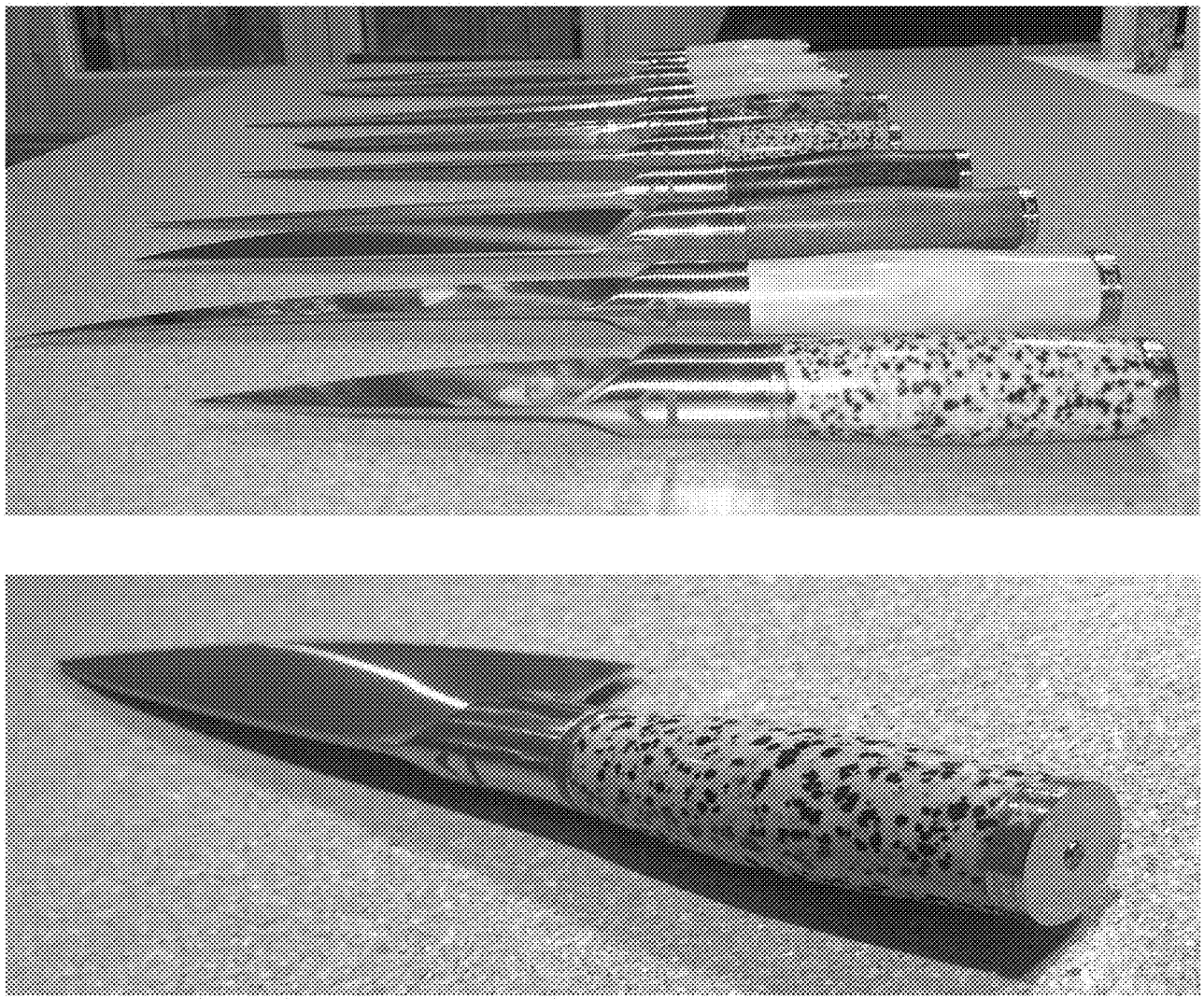
FIG. 10 is images of different customized knives that are assembled and customized in accordance with at least one embodiment.
Figure 12:
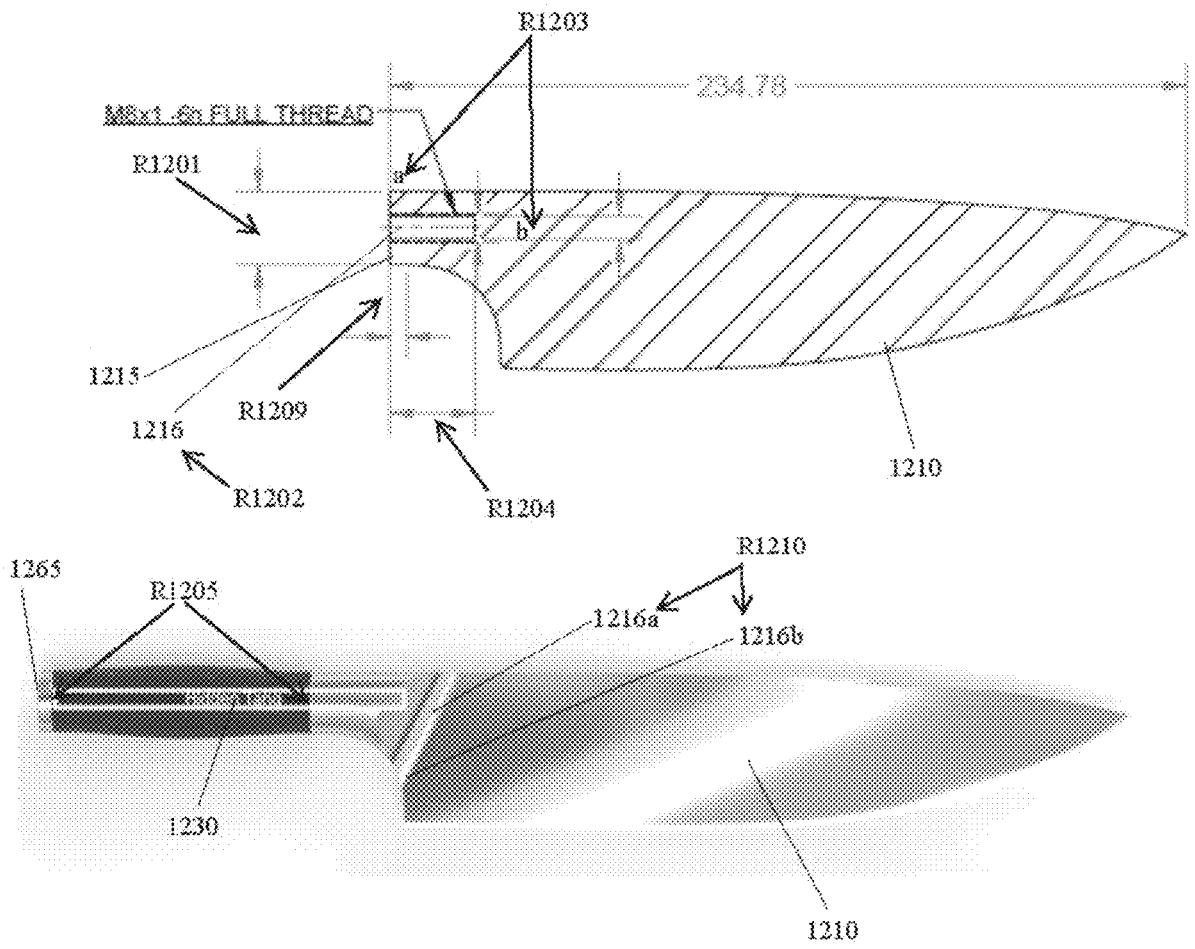
FIG. 12 illustrates the geometric requirements for the components and assembly of a knife in accordance with at least one embodiment.

Examples of different types of knives, with different type of materials and different types of blades, produced and assembled in accordance with at least one embodiment of the present invention are shown in FIG. 10.

Figure 14:
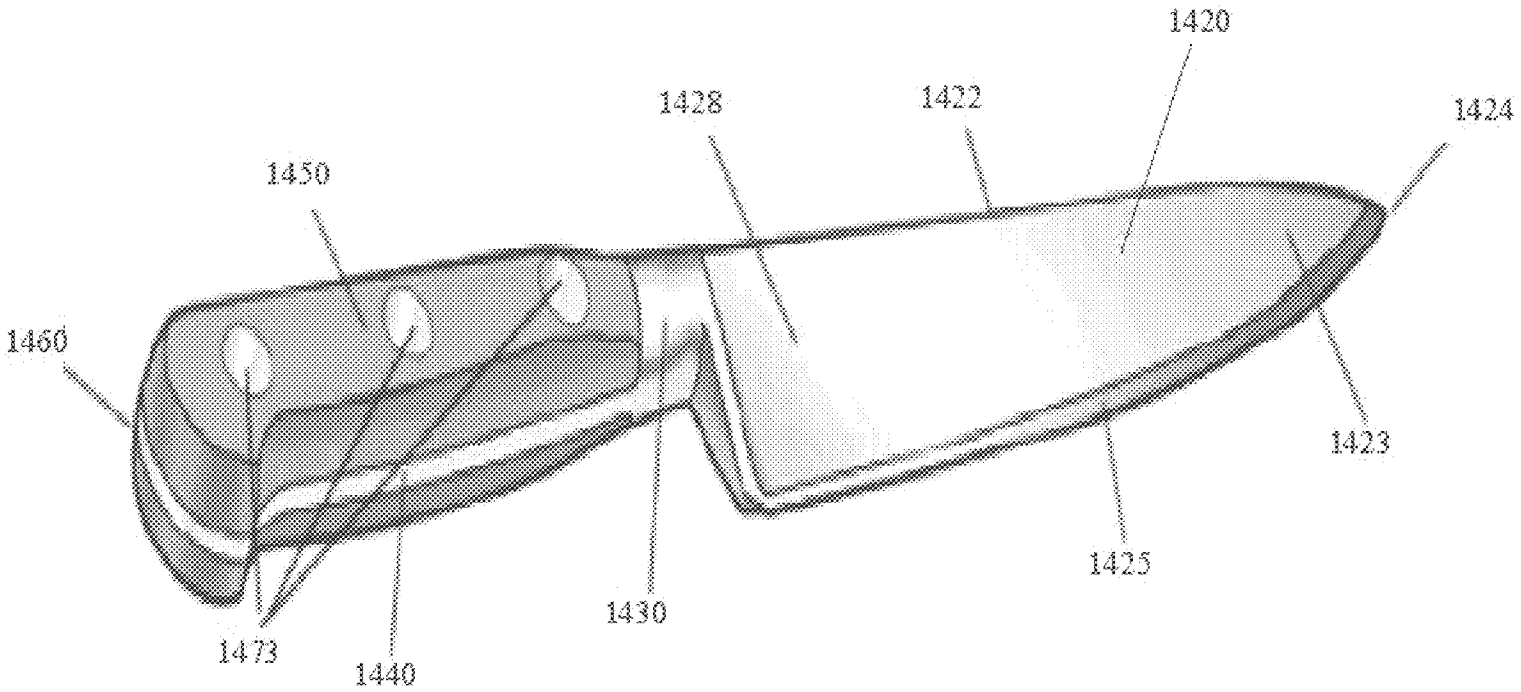
FIG. 14 illustrates the components and structure of a riveted handle knife, with a round bolster and a semi hidden tang, which is assembled in accordance with at least one embodiment.

An example of a riveted version of a knife with a round bolster, constructed in accordance with at least one embodiment of the present invention is illustrated in FIG. 14. A blade 1420 has a spine 1422 and an edge 1425. In the front, the blade has a tip 1423 portion and a sharp point 1424. A round (or near round) tubular bolster 1430 (at the section closest to the handle) extends from the heel portion 1428 of the blade, connecting through a hidden (partially or fully hidden) tang 1440 to the handle 1450 by multiple rivets 1473, through the grooves. The handle terminates in a butt section 1460.

In all cases it is understood that the above-described arrangements are merely illustrative of the many possible specific embodiments which represent applications of the present invention. Numerous and varied other arrangements can be readily devised in accordance with the principles of the present invention without departing from the spirit and the scope of the invention.

I hereby claim:

1. A method of assembling a knife, comprising:

selecting a metal blade having a cutting surface and a rounded bolster, having an opening;

selecting a handle;

drilling an inner channel throughout a length of the handle;

selecting a hidden tang having a middle part, a first and a second end, wherein the tang has a generally cylindrical butt on the first end of the hidden tang and a lateral elongated member extending perpendicularly from the butt in the middle part and ending in the second end;

fitting the lateral member of the tang through the drilled inner channel of the handle;

receiving the blade with the rounded bolster; and attaching the second end of the tang inside the opening in the rounded bolster.

2. The method of claim 1, further including the steps of:

assembling the received blade and bolster with the handle, the tang and the butt of the tang into a knife, without grinding or polishing the assembled knife or any of the assembled components after the assembly with the handle.

3. The method of claim 1, further including the steps of:

using at least one round filet for at least one of an outer surface of the bolster that connects to the handle, an outer surface of the handle that connects to the bolster, an outer surface of the handle that connects to the butt, and an outer surface of the butt that connects to the handle.

4. The method of claim 1, further including the steps of:

inserting and fixing a tube within a cavity in an outer surface of the butt of the hidden tang, and inserting and fixing a stone within a hollow part of the tube.

5. The method of claim 1, further including the steps of:

inserting one or more rings between the handle and the bolster and between the handle and the butt of the tang.

6. The method of claim 1, further including the steps of:

selecting a natural material for at least a portion the handle.

7. The method of claim 1, further including the steps of:

selecting a diameter of the opening drilled within the handle to be at least an extra 0.5 mm wider than a diameter of a longitudinal member of the tang extending through the channel in the handle, and assembling the tang and the handle using a one or more clamps and glue, configured to hold the bolster and the handle in a substantially centered position with respect to the bolster surface connected to the handle and with respect to the butt of the tang connected to the handle.

8. The method of claim 1, further including the steps of:

selecting the blade, the bolster, the tang, and the handle based on a geometric requirements, said requirements comprising:

requiring that a diameter of a blade bolster that connects to the handle is substantially the same as a diameter of the butt of the tang that connects to the handle on an opposite end;

requiring that the opening in the bolster is centered in the middle part of the bolster, and the opening in the bolster is configured to accommodate a threaded part of the tang;

requiring that the back bolster surface and a handle end closer to the back bolster surface have a corresponding geometric curvature;

requiring that a surface on the butt that connects to the handle and a handle end closer to the butt have a corresponding curvature;

requiring that the handle does not curve away from the attached blade, and remains centered along an axis of the bolster opening; and requiring that at least one of a back bolster surface that connects to the handle, a side surface of the handle and an inside surface of the butt that connects to the handle includes a rounded filet surface.

9. A method of selecting and assembling a knife comprising:

receiving a selection from a purchaser for a metal blade having a cutting surface and a rounded bolster, having an opening;

receiving a selection from a purchaser for a handle made at least partially from a natural material;

providing instructions to drill an inner channel throughout a length of the handle;

receiving a selection of a hidden tang having a middle part, a first end and a second end, wherein the tang has a generally cylindrical butt on the first end of the hidden tang and a lateral elongated member extending perpendicularly from the butt in the middle part and ending in the second end;

providing instructions for fitting the lateral member of the tang through the drilled inner channel of the handle;

providing instructions for attaching the second end of the tang inside the opening in the rounded bolster; and providing instructions for assembling the blade, the bolster, the handle, the tang and the butt of the tang into a knife, without grinding or polishing the assembled knife or any of its components after assembly.

* * * * *